US005721085A

United States Patent [19]

Oshiba et al.

[11] Patent Number: 5,721,085

[45] Date of Patent: Feb. 24, 1998

[54] ELECTROPHOTOGRAPHIC IMAGE FORMING METHOD

[75] Inventors: Takeo Oshiba; Akihiko Itami; Katsumi Matsuura, all of Hachioji, Japan

[73] Assignee: Konica Corporation, Tokyo, Japan

[21] Appl. No.: 717,625

[22] Filed: Sep. 23, 1996

[30] Foreign Application Priority Data

Sep. 27, 1995 [JP] Japan ..... 7-249484

[51] Int. Cl.[6] ..... G03G 13/095

[52] U.S. Cl. ..... 430/125; 399/350

[58] Field of Search ..... 430/125, 66; 399/350

[56] References Cited

U.S. PATENT DOCUMENTS

| | | | |
|---|---|---|---|
| 3,936,183 | 2/1976 | Sadamatsu | 399/350 |
| 4,007,982 | 2/1977 | Stange | 430/125 |
| 4,111,545 | 9/1978 | Meltzer | 430/125 |
| 4,863,823 | 9/1989 | Hiro et al. | 430/66 |
| 4,875,070 | 10/1989 | Hattori | 430/125 |
| 5,436,099 | 7/1995 | Schank et al. | 430/66 |
| 5,521,691 | 5/1996 | Morimoto et al. | 399/350 |
| 5,532,101 | 7/1996 | Nozawa et al. | 430/125 |

*Primary Examiner*—Christopher D. Rodee
*Attorney, Agent, or Firm*—Frishauf, Holtz,Goodman, Langer & Chick, P.C.

[57] ABSTRACT

Disclosed is an image forming method for an electrophotographic photoreceptor, comprising steps of:

(1) charging said photoreceptor which is moved in a predetermined direction, (2) imagewise exposing on said charged photoreceptor, (3) developing said imagewise exposed photoreceptor with a developer to form a toner image, (4) transferring said toner image onto an image receiving material, and (5) cleaning a residual toner on said photoreceptor with a cleaning blade after transferring said toner image, wherein said cleaning blade has a fixed end portion and a free end portion, said cleaning step comprising:

urging said free end portion in a direction counter to said predetermined direction of the photoreceptor, wherein said photoreceptor has a static friction coefficient of not more than 1.0 to said cleaning blade so that said free end portion of said cleaning blade is oscillated in an amplitude of 10 μm to 200 μm with the movement of the photoreceptor.

5 Claims, 3 Drawing Sheets

ELECTROPHOTOGRAPHIC IMAGE FORMING METHOD

FIELD OF THE INVENTION

The present invention relates to a method of forming images by the use of electrophotographic process, which is used in copying machines, printers, etc.

BACKGROUND OF THE INVENTION

Heretofore, in the method of image formation by the use of electrophotographic process, a blade-cleaning process using a resilient rubber blade has most popularly been employed in order to remove residual toner particles remained on the surface of photoreceptors in the view of easy handling.

According to this method, toner remaining on the above-mentioned photoreceptor are cleaned by oscillation energy of the so-called step-slip movement caused by reciprocating motion of the front edge of the blade.

In the method of image-forming process using an organic photoreceptor, not only removal of the remaining toner on the above-mentioned photoreceptor, but also wear and scratch can be caused. Thus, a method of conferring slippery nature on the outermost surface of the above-mentioned photoreceptor by incorporating a lubricating substance in the above-mentioned outermost surface layer has been proposed. For example, Japanese Patent O.P.I. Publication No. 61-219049(1986) discloses a method of incorporating a silicone resin or a fluorinated resin as a binder resin in the charge transport layer, which forms the outermost surface layer of photoreceptors, and Japanese Patent O.P.I. Publication No. 63-58352(1988) or Japanese Patent O.P.I. Publication No. 63-65449(1988) proposes a method of incorporating silicone fine particles or fluorinated fine resin particles.

In the electrophotographic industry, images with enhanced image quality have been demanded and, for this reason, preparation of toner with fine particles has been investigated. For example, Japanese Patent O.P.I. Publication No. 60-131551(1985) discloses the use of toner having the average particle diameter of not more than 10 μm.

However, when the surface of the photoreceptor, the outermost surface layer of which is incorporated with a lubricating substance, due to smallness of the average diameter of the toner particles, wear and abrasion of the surface of the photoreceptor can be improved, however, insufficient cleaning is likely to be caused more often, which is often accompanied with increased fogging and degrading image qualities. Particularly when the toner particles in the developer used for development are fine ones, degrading of image quality due to the above-mentioned insufficient cleaning becomes remarkable.

The object of the present invention is to provide a method of forming images, whereby images with improved image quality and high durability can stably be obtained even during repeated image-forming operation without causing degradation in the image due to wearing or abrasion of the photoreceptor and fogging in the image, spotting and streaking troubles due to insufficient cleaning, and an apparatus used therefor.

SUMMARY OF THE INVENTION

The above-mentioned object of the present invention can be achieved by the following items:

[1] In an image forming method of forming a large number of images on the surface of a electrophotographic photoreceptor by repeating steps of electrification, imagewise exposure, development, transfer, and a cleaning step on the surface of a photoreceptor using a cleaning blade, wherein said method being characterized in carrying out cleaning by making the static friction coefficient of said photoreceptor to said cleaning blade to be not more than 1.0, said cleaning blade being in contact with said photoreceptor in the counter direction and, oscillating said cleaning blade with the amplitude of oscillation between 10 and 200 μm.

[2] The image forming method of [1], wherein a developer used in said development step comprises a toner having a volume average particle size of 2 to 9 μm.

[3] The image forming method of [1] or [2], wherein said photoreceptor comprises a conductive support having provided thereon, in sequence, a charge generating layer and a plurality of charge transporting layers, the outermost surface layer of said plurality of charge transport layers comprises a lubricating material.

[4] The image forming method of [3], wherein said lubricating material is of either a resin or resin particles having an organosiloxane structure.

[5] The image forming method of [3], wherein said lubricating material is a fluorine-containing resin or resin particles thereof.

[6] The image forming method of [1] through [5], wherein the static friction coefficient of the above-mentioned photoreceptor against the cleaning blade is between 1.0 and 0.1.

[7] The image forming method of [1] through [6], wherein said cleaning blade has a repulsion resilience of 20 through 60% to said photoreceptor at a room temperature (20° C.) and a normal relative humidity (60% RH) and more preferably, 35 through 60%.

[8] In an apparatus for forming a large number of images comprising, around the peripheral circumference of an electrophotographic photoreceptor, means for electrification, imagewise exposure, development, image transfer and cleaning using a cleaning blade, respectively, wherein said apparatus being characterized in that the static friction coefficient of said photoreceptor against said cleaning blade is made to be not more than 1.0, that said cleaning blade is contact with said photoreceptor to the counter direction and that cleaning is performed by oscillating said cleaning blade with the amplitude of oscillation of 10 through 200 μm.

[9] The apparatus of [8], wherein a developer used in the above-mentioned development step comprises toner particles having a volume average particle diameter of 2 through 9 μm.

Figure 1:
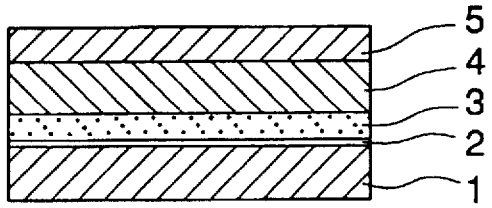
[FIG. 1]

A structural cross-sectional view of the photoreceptor according to the present invention in which a plurality of charge transfer layers are laminated.

[FIG. 2]

A structural schematic view explaining the method according to the present invention.

[FIG. 3]

A structural schematic view explaining the mechanism of cleaning.

[FIG. 4]

A structural schematic view explaining the mechanism of cleaning

[EXPLANATION OF SYMBOLS]

1: Electroconductive Support

2: Intermediate layer

3: Charge generating layer
4. First charge transporting layer
5: Second charge transporting layer
10: Organic photoreceptor drum
11: Charging device
12: Imagewise exposure
13: Developing unit
14: Transferring device
15: Separation electrode
16: Transport means
18: De-electrification device
19: Cleaning blade
20: De-electrifying device
30: Piezo sensor
31: Computer
p: Transfer material
θ: Contacting angle
l: Free length
P: Contacting load

DETAILED DESCRIPTION OF THE INVENTION

The present inventors have found, after intensive investigation on the problems mentioned above, that the above-mentioned problems can be solved by using a photoreceptor in which its outermost layer contains a lubricating material and a developer contains fine toner particles, further by controlling the static friction coefficient of said photoreceptor against the cleaning blade and the amplitude of oscillation of said cleaning blade and, more preferably, oscillation of said cleaning blade and, more preferably, repulsion resilience of the cleaning blade contacting angle, free length and contacting load of the cleaning blade to the photoreceptor and, thus, the present invention has been completed.

In the above-mentioned items 1 through 9, when the static friction coefficient of the photoreceptor against the cleaning blade is more than 1.0, deflection of the cleaning blade at the front edge of the cleaning blade takes place, which often causes black streaks and insufficient cleaning.

The above-mentioned static friction coefficient can be usually measured, when the above-mentioned photoreceptor is of a sheet-shaped, flat-plate or a endless belt, using a surface testing apparatus (Type: HEIDON-14, a product of HEIDON Co.).

However in practice, the photoreceptors which are commonly integrated in the electrophotographic image-forming apparatus are of cylindrical drums and, in that case the above-mentioned static friction coefficient is obtained by measuring rotary torque of T(kg·cm) of the photoreceptor drum.

In the case where the photoreceptor is an endless belt type, the above-mentioned static friction coefficient is similarly obtained by measuring rotary torque of T (kg·cm).

That is to say, by measuring rotary torque of the photoreceptor drum per se $T_1$ and rotary torque $T_2$ of the photoreceptor drum, onto which the cleaning blade is pressure contact with load F(kg), the static friction coefficient is calculated from the following equation.

$$\text{Static friction coefficient } \mu=(T_2-T_1)/(F\cdot\gamma),$$

provided in the formula, γ denotes a radius of the photoreceptor drum(cm).

Further in the present invention, when the amplitude of oscillation of the cleaning blade is less than 10 μm, energy of oscillation becomes small, toner particles slip through under the cleaning blade, thus causing image fogging and, besides, spotting and streaking troubles are more likely to be caused.

When, on the other hand, amplitude of the above-mentioned oscillation is more than 200 μm, oscillation energy of the above-mentioned cleaning blade becomes too big, the cleaning blade causes jumping on the surface of the photoreceptor, so that bring streaking (black) trouble and insufficient cleaning take place.

Measurement of the above-mentioned oscillation size of the cleaning blade can be made as follows.

A sensor of an acceleration detecting apparatus type NP-3210, a product of Ono Sokki Co., Ltd., was fixed to the center of the cleaning blade, i.e., 3 mm from the front edge, and oscillation at the time when rotation speed of the photoreceptor became constant, was measured for the period of ten seconds by the sensor. Then, this output data from said sensor was processed with a 4-channel intelligent FF Analyzer ONO SOKKI CF6400, A Product of Ono Sokki Co., Ltd., to obtain an average value of the amplitude of the above-mentioned oscillation and this was assumed to be the oscillation size.

According to one of preferable embodiments of the present invention, the photoreceptor comprises on a electroconductive support a charge generation layer and a plurality of charge transport layers and, among the above-mentioned charge transport layers, the charge transport layer which forms the above-mentioned outermost surface layer is incorporated with the above-mentioned lubricating material, to make the static friction coefficient of the above-mentioned outermost layer against the above-mentioned cleaning blade to be not more than 1.0.

The reason why the photoreceptor is made to have the above-mentioned structure is that in the case where a lubricating material is incorporated in the whole charge transport layers, electrophotographic performance of the photoreceptor is degraded. Then the charge transport layer is constituted with a plurality of charge transport layers, and layers located in the lower position of the charge transport layers are not incorporated with the above-mentioned lubricating material or if incorporated, to an extent which does not have adverse effect on the electrophotographic properties, thus to sufficiently secure the electrophotographic performance of the photoreceptor, as well as incorporating the above-mentioned lubricating material in a sufficient amount in the outermost charge transporting layer, to secure an anti-abrasion property of the same by making the static friction coefficient to be not more than 1.0 and, more preferably, 0.1 through 1.0.

A representative example of a photoreceptor which is formed of by laminating a plurality of charge transporting layers on the above-mentioned charge generating layer is shown in FIG. 1. In this figure numerical symbols respectively denote as follows:

1. conductive substrate,
2. intermediate layer,
3. charge generating layer,
4. first charge transporting layer,
5. second charge transporting layer.

For the above-mentioned lubricating material, resins or fine particles thereof containing a siloxane structure or fluorine atoms can be used preferably. Further as the above-mentioned lubricating material, it is also possible to incorporate inorganic particles.

In the case where the above-mentioned resin fine particles are used, the volume average particle size is 0.05 through 10 μm and, more preferably, 0.1 through 5 μm, and it is incorporated in the outermost layer (the second charge transporting layer 5) of the photoreceptor at a quantity of 0.01 through 50 parts by weight with respect to 100 parts by weight of binder resin.

As for the above-mentioned lubricating material, for example, resins or fine resin particles having a siloxane structure can be mentioned. For example, "TOSPEARL", which is a tradename and is a product of Toshiba Silicone Co., Ltd., is sold and available on the market.

Further, polycarbonate resins or fine resin particles thereof, in which a siloxane structure is contained as disclosed on pages 22 through 25 of Japanese Patent Application No. 6-138884(1994) and as disclosed on pages 13 through 36 of Japanese Patent Application No. 6-258669 (1994), polycarbonate resins or fine resin particles thereof, in which a siloxane structure is grafted may also be mentioned.

Further, as for other examples of the lubricating material, those which are disclosed in Column 1, on page 2 of Japanese Patent O.P.I. Publication No. 4-284459(1992) including, for example, fluorine-containing resins or resin fine particles thereof selected from the group consisting of polytetrafluoro ethylene, polychlorotrifluoro ethylene, polyvinylidene fluoride, polyfluoro ethylene, polydichlorodifluoro ethylene, tetrafluoro ethyleneperfluoroalkylvinyl ether copolymers, tetrafluoro ethylenehexafluoropropylene copolymers, tetrafluoro ethylene-ethylene copolymers and tetrafluoro ethylene-hexafluoropropyleneperfluoroalkylvinyl ether copolymers can also be mentioned.

As for the above-mentioned conductive substrate 1, for example, metal plate made of aluminum, stainless, iron, etc.; an electroconductive metal layer such as aluminum, paradium or gold is provided by lamination or vacuum deposition on those supports having a surface having flexibility; a layer comprising an electro-conductive compound such as an electro-conductive polymer, indium oxide, tin oxide, etc. by coating or deposition is provided on the surface of a flexible support such as paper or plastic film. Thus, the conductive substrates can be obtained.

As for the intermediate layer 2, which may optionally be employed as needed in the present invention, for example, casein, polyvinyl alcohol, nitrocellulose, ethylene-acrylic acid copolymer, polyvinyl butyral, phenol resins, polyamides(such as nylon-6, nylon-66, alkoxymethylated nylon, etc.), polyurethane, gelatin, aluminum oxide, etc. can be used. As for the thickness of a subbing layer, 0.1 to 10 μm is preferable and, 0.1 to 5 μm is particularly preferable.

The above-mentioned charge generating layer 3 is a layer containing a charge generating material. For the charge generating material, there is no specific limitation and it includes, for example, phthalocyanine pigments, polycyclic quinone pigments, azo pigments, perylene pigments, indigo pigments, azulenium pigments, quinacridone pigments, squalium pigments, cyanine dyes, pyrilium dyes, thiopyrilium triphenyl methane dyes, styryl dyes can be used, and these dyes are employed independently or by dispersing these dyes in the resin. For the resin used herein, for example, styrene-acrylic resins, polycarbonate resins, polyester resins, acrylic resins, polyvinyl chloride resins, polyvinylidene chloride resins, styrene resins, polyvinyl acetate resins, styrene-butadiene resins, vinylidene chloride-acrylonitrile resins, vinyl chloride-vinyl acetate resins, vinyl chloride-vinyl acetate resins, vinyl chloride-vinyl acetate-maleic acid anhydride resins, silicone resins, silicone alkyd resins, phenolformaldehyde resins, polyvinyl acetal resins, polyvinyl butyral resins can be mentioned.

Thickness of the above-mentioned charge generation layer 3 is generally 0.01 through 10 μm.

Next, the above-mentioned first charge transport layer 4 and the second charge transport layer 5 are layers containing a charge transporting material. There is no specific limitation as to the charge transporting material. For example, oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilben compounds, amine derivatives, oxazolone derivatives, benzthiazole derivatives, benzimidazole derivatives, quinazoline derivatives, benzofurane derivatives, acrydine derivatives, phenadine derivatives, aminostilben derivatives, poly-N-vinylcarbazole derivatives, poly-1-vinyl pyrene compounds, poly-9-vinylanthrathene compounds, etc. can be mentioned. These resins may be employed independently and may be dispersed or dissolved in a resin. As for the resin used herein, for example, styrene-acrylic resins, polycarbonate resins, polyester resins, acrylic resins, polyvinyl chloride resins, polyvinylidene chloride resins, styrene resins, polyvinyl acetate resins, styrene-butadiene resins, vinylidene chloride-acrylonitrile resins, vinyl chloride-vinyl acetate resins, vinyl chloride,-vinyl acetatemaleic acid anhydride resins, silicone resins, silicone-alkyd resins, phenolformaldehyde resins, polyvinyl acetal resins, polyvinyl butyral resins, etc. can be mentioned.

The thickness of the above-mentioned first charge transport layer 4 is 5 through 50 μm and, preferably, 10 through 40 μm. The thickness of the second charge transport layer 5 is 0.2 through 30 μm and, preferably, 0.4 through 20 μm.

The volume average particle size of the above-mentioned resinous fin particle is measured using laser diffraction/scattering granularity distribution measuring apparatus type LA-700 (a product of Horiba Manufacturing Co., Ltd).

Next, image formation process of the present invention is explained.

Figure 2:
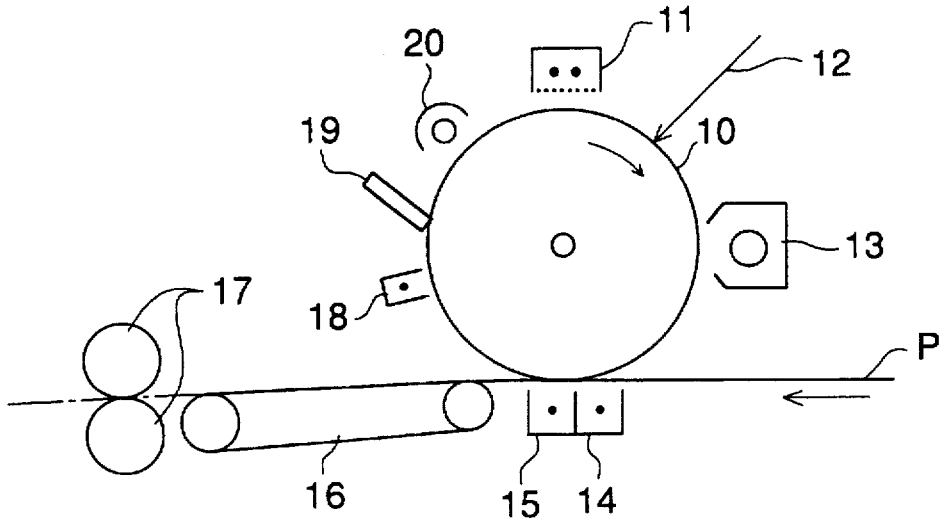

FIG. 2 is a schematic structural drawing explaining the image forming method of the present invention.

In FIG. 2, numerical symbol 10 denotes an organic photoreceptor which rotates in the direction of the arrow. 11 is an electrification device conferring uniform electric charge on the above-mentioned photoreceptor. This electrification device may be a corona discharging and/or electrification device, a roller electrification device or a magnetic brush electrification device. 12 denotes an analogue image-exposure or a digital image exposure by using an LEO or an LBO. By this image exposure, an electrostatic latent image is formed on the surface of the photoreceptor. This electrostatic latent image is developed by either contact developing process or non-contact developing process, by using a developing unit 13 containing a developer, which may be either a one-component-type or a two-component-type developer and, preferably, a two-component-type developer comprising fine toner particles having a volume average particle diameter of 2–9 μm, thus so as to form a toner image on the above-mentioned photoreceptor. This toner image is, then, electrostatically transferred onto a transfer material p with a transfer device (transfer device using corona discharger or a roller transfer device), separated with a separation electrode 15 and transported to a fixing unit 17 by a transport means 16, thereby to fix the transferred toner image.

After transfer of the toner image, the surface of the photoreceptor is subjected to discharge with a discharging device 18 and, then cleaned by contacting with the cleaning blade 19 of the present invention in the counter direction to that of the above-mentioned photoreceptor 10. Then, the surface of the photoreceptor is discharged by a discharging lamp 20 so as to enter in the stand-by condition for preparing next image formation.

Figure 3:
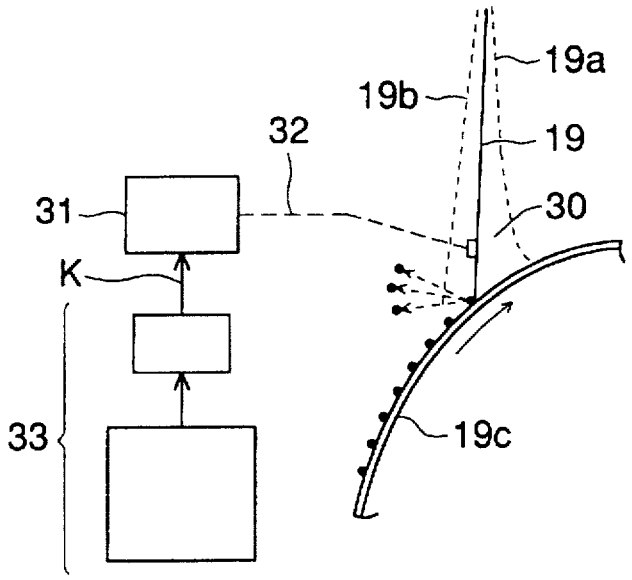

The above-mentioned cleaning blade 19 is made of a resilient urethane plate having repulsion resilience of 20–60% at room temperature. The cleaning blade is, as shown in FIG. 3, brought in pressure contact with the photoreceptor 10 in the counter-direction to that of the photoreceptor 10 and, corresponding to mutual coefficient of friction, it shifts to a position of the dotted line 19*a* with the rotation of the photoreceptor drum to the direction of the arrow. Then, the cleaning blade repulsively slips to the position of the dotted line 19*b* by the repulsion resilience, during which toner particles 19*c* are removed from the surface of the above-mentioned photoreceptor drum and, thus, cleaning is carried out. In the present invention, the above-mentioned repulsion resilience can be measured by the method disclosed in JIS-K-6301.

In the present invention, when the above-mentioned step-slip is performed, magnitude of the oscillation $K_1$ based on the above-mentioned method is 10 through 200 μm. In the above-mentioned measuring method, acceleration of the blade oscillation is read by a piezo sensor 30, which is set, as shown in FIG. 3, at the position, which is 3 mm apart from the front edge of the blade and thus obtained acceleration signal 32 is inputted into a computer 31, arithmetic operation 33 and K μm, which is magnitude of oscillation of the cleaning blade at the position, where the sensor is set, is put out. Comparing this data with an appropriate value $K_1$, it is determined whether the blade condition is proper or improper. In a case where the conditions are determined to be improper, either the blale is replaced with a new one or contacting pressure P g/cm, contacting angle θ, free length 1 mm, or the other parameters are regulated so as to make it possible to form an image under proper conditions.

In the present invention, as for contacting weight P, contacting angle θ°, and free length l, P=15–20 g/cm, θ=15°–25° and l=8–12 mm, are preferable.

Figure 4:
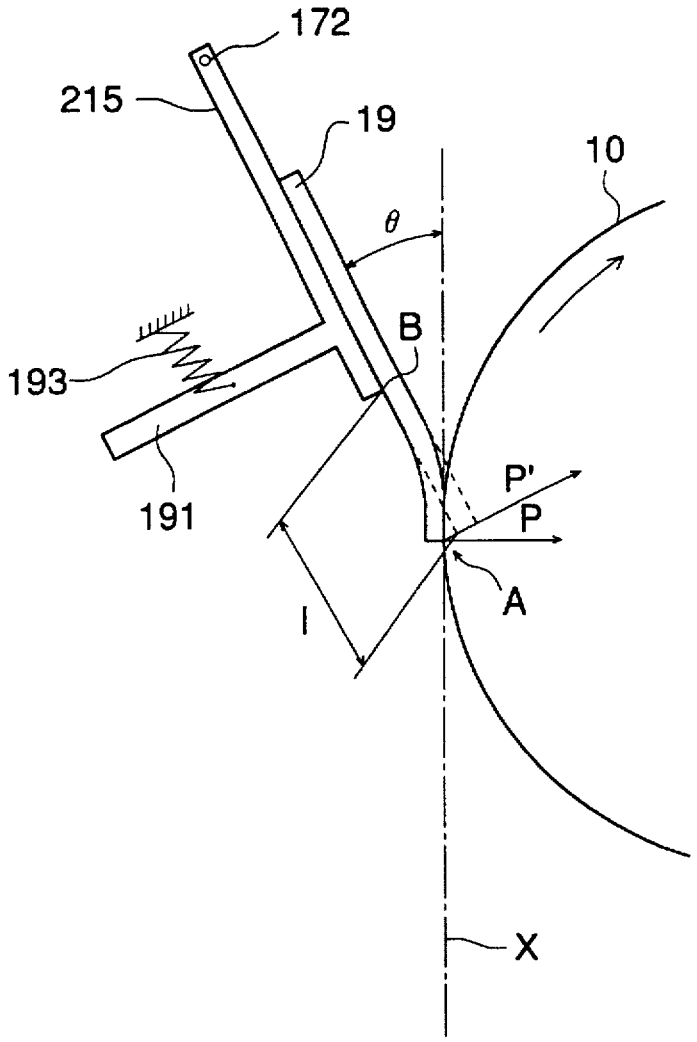

In FIG. 4, a fixed end portion of a cleaning blade 19 is fixed on a L-shaped supporting member. Since arm member 215 of L-shaped supporting member is rotatably fixed around a shaft 172 and a lever of L-shaped supporting member is urged by a spring 193, a free end portion of the cleaning blade 19 is brought in contact with the photoreceptor 10 and is urged so as to counter to the rotation of the photoreceptor.

The above-mentioned free length l denotes, as shown in FIG. 4, a distance between the edge portion of a support member 191 and the front edge point of the blade before deformation. Further, contacting load P is a vector value of the contacting pressure P' in the direction of the normal when the blade 19 is brought in contact with the photoreceptor drum 10.

Still further, contacting angle θ represents an angle formed by a tangential line X at the contacting point A and the blade before deformation, which is represented as a dotted line, in figure.

In the present invention, when the average volume diameter is not more than 2 μm, toner scattering during development tends to occur and toner goes through the cleaning blade in the cleaning step, causing insufficient cleaning, and image fogging and streak defects can easily take place.

When, on the other hand, the average volume diameter is not less than 9 μm, resolving power of the image easily tends to be lowered.

The volume average particle diameter of the toner is measured using Coulter Counter, a product of Coulter Inc.

EXAMPLES

Below, the present invention is explained in detail with reference to working examples, however, the embodiments of the present invention are not limited to these.

<Preparation of Photoreceptor 1>

30 g of polyamide resin "CM-8000", a product of Toray Industries Inc., was put into a mixed solvent consisting of 900 ml of methanol and 100 ml of 1-butanol and is dissolved therein at 50° C. After this solution was cooled down to the room temperature, a 0.5-μm-thick intermediate layer was formed by dip coating method on a cylindrical aluminum drum, of which external diameter and length were 80 mm and 355.5 mm, respectively.

Next after 5 g of a polyvinyl butyral resin, "ESLEC BX-1", A Product of Sekisui Chemical Co. Ltd., was dissolved in 1000 ml of methylethyl ketone and, further, 10 g of a charge generating material G1 having the chemical structure given below was mixed, dispersion was performed for 20 hours using a sand mil. Then, this solution was coated on the above-mentioned intermediate layer by dip coating to form a charge generation layer having a thickness of 0.5 μm.

Then, 100 g of a charge transporting material T and as a binder resin B1 100 g of BPZ-type polycarbonate-type resin "PANLITE TS-2050", A PRODUCT OF Teijin Kasei Co., Ltd., were dissolved in 1000 ml of dichloro methane. Using this solution, charge transporting layer having a thickness of 20 μm was formed on the above-mentioned charge generation layer with a circular slidehopper coater.

Charge generating material G1:

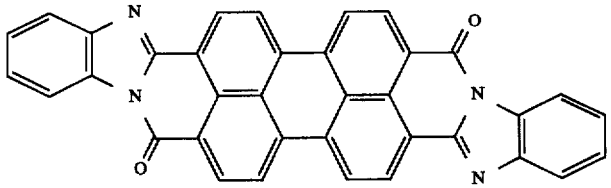

-continued

A mixture of

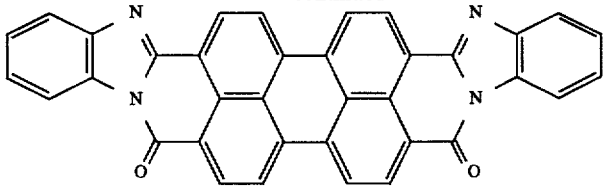

Charge transporting material T

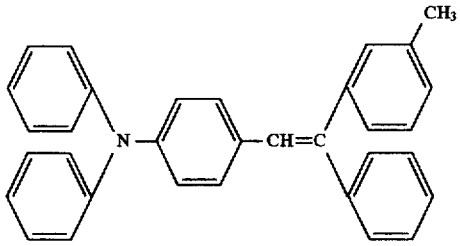

Thereafter, as in the above-mentioned first charge transporting layer, 100 g of the charge transporting material and 120 g of a binder resin B1 were dissolved in 1000 ml of dichloro methane. To this solution 70 g of organic fine particles A1 was added and dispersed in the solution in a ultra-sonic dispersing chamber for 20 minutes. Then, using this solution, second charge transporting layer having a thickness of 5 μm was formed with the same whirl coating apparatus on the above-mentioned first charge transport layer, thus to prepare Photoreceptor 1.

TABLE 1

| Photo-receptor No. | Organic Fine Particles Kind | Volume Average Particle Diameter (μm) | Addition amount (g/Binder) | Outermost Surface Layer (Binder used in the 2nd CTL 5) |
|---|---|---|---|---|
| 1 | A1 | 2.0 | 70/120 | B1 |
| 2 | " | " | — | B2 |
| 3 | A2 | " | 10/120 | B1 |
| 4 | A3 | " | 60/120 | " |
| 5 | A4 | " | 50/120 | " |
| 6 | — | " | — | " |

Organic Fine particles

A2: Fluoro Resin fine particles "Lubron L-2" (a product of Daikin industries Ltd.

A1: Silicone resin fine particles "TOSPEARL 120" (A PRODUCT OF Toshiba Silicone Co., Ltd.)

A3: Silicone resin fine particles "TOSPEARL 130" (A PRODUCT OF Toshiba Silicone Co., Ltd.)

A4: Silicone resin fine particles "TOSPEARL 145" (A Product of Toshiba Silicone Co., Ltd.)

Binder

B1: BPZ-Type Polycarbonate Resin "PANLITE TS-2050" (a product of Teijin Kasei Co., Ltd.)

B2: A copolymer Resin consisting of (1) and (2), provided that n1:n2=80:20.

(1)

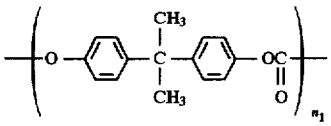

-continued (2)

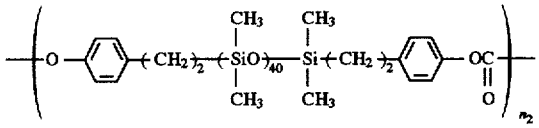

Provided that $n_1:n_2$ = 80:20

<Preparation of photoreceptor 2>

Photoreceptor 2 was prepared in the same manner as Photoreceptor 1, except that resin B2 was used instead of binder reesin B1 employed in the second charge transporting layer.

<Preparation of Photoreceptors 3 through 5>

Photoreceptors 3 through 5 were prepared in the same manner as a Photoreceptor 1, except that instead of adding 70 g of organic fine particles A1 were added to 120 g of binder resin B1 in the second charge transporting layer, 10 g of A2, 60 g of A3 and 50 g of A4 were added, respectively.

<Preparation of photoreceptor 6>

Photoreceptor 6 was prepared in the same manner as photoreceptor 1, except that organic fine particles A1 in the second charge transporting layer was excluded.

<Preparation of Developer 1>

To 100 parts by weight of polyester resin as a binder resin, 10 parts by weight of carbon black and 3 parts by weight of low molecular weight polypropylene (Mn=2500) were mixed, fused, kneaded, pulverized and classified to obtain colored particles having the volume average particle size of 5 μm, and, to this, 0.4 parts by weight of hydrophobic silica "Aerosil R-972" (a product of Nippon Aerosil Co., Ltd.) was mixed to obtain toner.

Developer 1 was obtained by mixing 5 parts by weight of the above-mentioned toner and 95 parts by weight of ferrite particles having a volume average particle size of 80 82 m, wherein the surface are coated with a fluororesin copolymer resin having a copolymerization ratio of 2,2,2-trifluoroethyl methacrylate to styrene being 1:1.

<Preparation of Developers 2 through 5>

Developers 2 through 5 were prepared in the same manner as in Developer 1, except that each volume average particle sizes were varied to 8 μm, 3 μm, 10 μm and 1 μm, respectively.

<Image Evaluation>

Using a modified electrophotographic copying machine Konica U-BIX4155, a product of Konica Corporation, on which Photoreceptors 1 through 6, Developers 1 through 5 and cleaning blades 1 through 3 made of urethane rubber each having different repulsion resilience(%) were mounted in this order as shown in Table 2, 100,000-time copying tests were conducted while varying conditions of the cleaning blade, i.e., contacting angle on the photoreceptor, contacting load, free length and oscillation magnitude of the cleaning blade as shown in Table 2.

After the 100,000th copying cycle, similarly, ten other random points were selected on the photoreceptor, and an average film thickness was calculated.

The reduced amount of thickness of the photoreceptor was obtained from the difference between the average film thickness on the beginning of the copying test and the average film thickness after the 100,000th copying cycle.

0072

Further measurement of resolution R was made by copying a chart having resolution of 1 line/mm–10 lines/mm and was determined by visual observation. Results are shown in Table 2.

TABLE 2

| | | | | | Conditions of the Blade | | | | | | | Resolving | |
|---|---|---|---|---|---|---|---|---|---|---|---|---|---|
| Sample No. | photo-receptor No. | Static friction Co-efficient | Devel-oper No. | Toner Particle Size (μm) | Blade No. | Repulsion Resilience (%) | Con-tacting Angle (°) | Free Length (mm) | Load (g/cm) | Amplitude of Oscillation (μm) | Reduced Amount of Thickness (μm) | Power (lines/mm) | Cleaning Perfor-mance |
| 1 Inventive | 1 | 0.54 | 1 | 5 | 1 | 58 | 18 | 8 | 20 | 50 | 0.7 | 6 | Good |
| 2 Inventive | 1 | 0.58 | 1 | 5 | 2 | 45 | 16 | 8 | 20 | 10 | 0.8 | 6 | Good |
| 3 Inventive | 1 | 0.56 | 1 | 5 | 1 | 58 | 20 | 8 | 16 | 150 | 0.6 | 6 | Good |
| C1 Comparative | 1 | 0.51 | 1 | 5 | 3 | 65 | 20 | 8 | 20 | 250 | 0.4 | 5 | BH ST |
| C2 Comparative | 1 | 0.58 | 1 | 5 | 2 | 45 | 12 | 10 | 20 | 2 | 0.5 | 4 | FPT |
| 4 Inventive | 2 | 0.21 | 1 | 5 | 1 | 58 | 18 | 8 | 20 | 80 | 0.7 | 6 | Good |
| 5 Inventive | 3 | 0.72 | 1 | 5 | 2 | 45 | 16 | 8 | 20 | 30 | 0.6 | 6 | Good |
| 6 Inventive | 4 | 0.93 | 1 | 5 | 1 | 58 | 18 | 8 | 20 | 180 | 0.6 | 6 | Good |
| C3 Comparative | 5 | 1.21 | 1 | 5 | 3 | 65 | 20 | 8 | 20 | 150 | 2.2 | 4 | 1BD ST |
| C4 Comparative | 6 | 1.85 | 1 | 5 | 1 | 58 | 20 | 8 | 16 | 105 | 4.8 | 4 | 3BD ST |
| 7 Inventive | 1 | 0.54 | 2 | 8 | 1 | 58 | 18 | 8 | 20 | 50 | 0.7 | 6 | Good |
| 8 Inventive | 1 | 0.54 | 3 | 3 | 1 | 58 | 18 | 8 | 20 | 50 | 0.7 | 6 | Good |

Note)
BH: Blade Hopping
ST: Streak defect occurs
FPT: Fogging due to Passingthrough of Toner Particles.
1BD: One Blade deflection in 100,000 copies.
3BD: 3 Blade deflections in 100,000 Copying.

This copying test was carried out under room temperature and the normal humidity (20° C., 60% RH), using a B4 size original image (covering ratio: 10%), containing a solid black, halftone and white background and reduced amount of thickness by abrasion (μm), image resolving power (lines/mm) and image formed by unsufficient cleaning were evaluated. Obtained results are shown in Table 2.

In this copying test at the starting time of a test machine static friction coefficients of the photoreceptor corresponding to the cleaning blade conditions (repulsion resilience, contacting angle, free length and contacting load) were measured respectively and results were given in Table 2.

In the present invention, by using a film thickness measuring apparatus "EDDY 560C" (a product of HELMUT FISCHER GMBHT Co.), the reduced amount of thickness of the photoreceptor was calculated by the following method.

At the beginning of the copying test, ten points were selected at random on the photoreceptor, the film thickness at each of the ten points were measured, and an average film thickness at the beginning of the copying test was calculated.

As is obvious from Table 2, examples according to the present invention exert excellent copying performance, on the contrary, comparative examples have at least one problem with respect to any one of properties shown in the table.

What is claimed is:

1. An image forming method for an organic electrophotographic photoreceptor, the method comprising steps of:

(1) charging said organic photoreceptor which is moved in a predetermined moving direction, wherein said organic photoreceptor comprising a conductive support having provided thereon, in sequence, a charge generating layer and a plurality of organic charge transporting layers, in which the outermost layer of said plurality of organic charge transporting layers comprises a lubricating material, (2) imagewise exposing said charged photoreceptor, (3) developing said imagewise exposed photoreceptor with a developer to form a toner image, wherein said developer contains a toner having a volume average particle size in the range of 2 to 9 μm;

(4) transferring said toner image onto an image receiving material, and (5) cleaning residual toner from said photoreceptor with a cleaning blade after transferring said toner image, wherein (i) said cleaning blade has a fixed end portion and a free end portion, and further having a repulsion resilience of 20 to 60%; and (ii) said photoreceptor has a static friction coefficient of not more than 1.0 to said cleaning blade, said cleaning step comprising:

urging said free end portion in a direction counter to said predetermined moving direction of the photoreceptor so as to bring said free end portion in contact with the surface of said photoreceptor, wherein said free end portion is shifted with the movement of said photoreceptor, said shifted free end portion generates repulsive resilient force in said cleaning blade so that said free end portion is returned by the repulsive resilient force in a direction reverse to said moving direction of said photoreceptor and said free end portion repeats the shifting in said moving direction and the returning in said reverse direction, whereby said free end portion of said cleaning blade is oscillated in an amplitude of 10 μm to 200 μm with the movement of the photoreceptor under the urging condition.

2. The image forming method of claim 1, wherein said lubricating material is a resin having an organosiloxane structure.

3. The image forming method of claim 1, wherein said lubricating material is a fluoro-containing resin.

4. The image forming method of claim 1, wherein said static friction coefficient is 0.1 through 1.0.

5. The image forming method of claim 1, wherein said cleaning blade has a repulsion resilience of 35 through 60% to said photoreceptor.

* * * * *